US005683012A

United States Patent [19]

Villaveces

[11] Patent Number: 5,683,012

[45] Date of Patent: Nov. 4, 1997

[54] BODY-WORN DISPENSER FOR DISINFECTING GEL

[76] Inventor: James Villaveces, 88 Eugenia Dr., Ventura, Calif. 93003

[21] Appl. No.: 460,628

[22] Filed: May 12, 1995

[51] Int. Cl.[6] ..... B67D 5/00

[52] U.S. Cl. ..... 222/82; 222/175; 222/321.7; 222/325

[58] Field of Search ..... 222/82, 83, 175, 222/162, 182, 183, 321.1, 321.7, 321.8, 321.6, 341, 325, 382, 383.1, 378, 402.13, 383.3, 185.1; 239/154, 329, 330

[56] References Cited

U.S. PATENT DOCUMENTS

| | | | |
|---|---|---|---|
| D. 317,984 | 7/1991 | Reynose et al. | D3/100 |
| 3,993,251 | 11/1976 | des Garets | 222/402.13 |
| 4,175,704 | 11/1979 | Cohen | 222/321.6 |
| 4,420,097 | 12/1983 | Motsenbocker | 222/131 |
| 4,703,871 | 11/1987 | Broker | 222/144.5 |
| 4,793,517 | 12/1988 | Washut | 222/129 |
| 4,944,429 | 7/1990 | Bishop et al. | 222/321.6 |
| 5,016,781 | 5/1991 | Ten Wolde | 222/325 |
| 5,037,389 | 8/1991 | Dooley | 604/77 |
| 5,129,999 | 7/1992 | Holland et al. | 204/131 |
| 5,148,949 | 9/1992 | Luca | 222/175 |
| 5,154,318 | 10/1992 | Lampard | 222/105 |
| 5,199,609 | 4/1993 | Ash, Jr. | 222/94 |
| 5,215,227 | 6/1993 | Farner | 222/321.6 |
| 5,341,993 | 8/1994 | Haber et al. | 222/321.6 |
| 5,348,193 | 9/1994 | Bruckner et al. | 222/175 |
| 5,429,301 | 7/1995 | Franks | 222/175 |
| 5,503,302 | 4/1996 | DeJonge | 222/321.7 |
| 5,509,578 | 4/1996 | Livingstone | 222/321.6 |

FOREIGN PATENT DOCUMENTS

| | | | |
|---|---|---|---|
| 365570 | 5/1990 | European Pat. Off. | 222/325 |

OTHER PUBLICATIONS

Intermittent Use of an antimicrobial hand gel for reducing soap–induced irritation of health care personnel, 1990.

Handwashing, Semimelweiss, and Chlorine, William Beck, M.D. Infection Controls 1988 vol. 9, No. 8.

"Role of hand contamination of personnel in the epidemiology of gram–negative nosocomial infections", 1975.

Ultracol Ethyl alcohol Gel Hand Rub, Dexide, Inc.

"Efficacy of Alcohol–Based Hand Rinses under Frequent–Use Conditions" 1986.

"Handwashing and Skin Physiolgic and Bacteriologic Aspects" 1985.

"Inactivation of Hepatitis B. Virus by Intermediate–to–High Level Disinfectant Chemicals" 1983.

"Bacterium Bedevils Hospital Patients", Health Briefing 1989.

"MDs' and Nurses' Unwashed Hands Held Nosocomial Infections Source" 1985.

*Primary Examiner*—Philippe Derakshani
*Attorney, Agent, or Firm*—Milton S. Gerstein

[57] ABSTRACT

A dispenser for dispensing an alcohol-glycerine disinfecting gel or liquid for use by doctors and nurses. The dispenser consists of a main housing which mounts a pumping mechanism for pumping out an alcohol-glycerine disinfecting gel from a replaceable, disposable supply-cartridge releasably mounted in the main housing. Since the main housing is small enough to fit within a person's hand, the doctor or nurse may dispense the contents of an alcohol-glycerine disinfecting gel simply by squeezing the two parts together. The dispensing of the gel is applied directly onto the fingers of the same hand that has squeezed the main housing to have caused such dispensing to occur. Owing to the small size of the main housing, the dispenser of the invention may be worn on-the-person, such as by the waist-belt.

15 Claims, 3 Drawing Sheets

BODY-WORN DISPENSER FOR DISINFECTING GEL

BACKGROUND OF THE INVENTION

The present invention is directed to a dispenser for dispensing a small amount of alcohol gel hand rub for use by physicians and nurses during their normal activities, which dispenser is carried on the person.

It has been well established that one of the most efficacious antimicrobial hand gel is one that contains alcohol. It has also been established that a potentially major source of infection, such as gram-negative nosocomial pathogens, may be transmitted via the hands of a physician or nurse, after he or she has examined a patient, and has not disinfected the hands. Because of the busy schedule that physicians and nurses experience, it is not usually practicable or possible to disinfect the hands after having examined a patient. Simple washing of the hands with soap and water will not effectively disinfect the hands, and, moreover, repeated and frequent washing of the hands will cause them to become chafed and chapped, which will discourage the doctor or nurse from washing the next time such should be performed. Thus, the hands may go unwashed altogether.

In order to better disinfect the hands, doctors and nurses use a disinfecting liquid, such as "Ultracol" manufactured by Dexide, Inc. of Fort Worth, Tex., which contains ethyl alcohol and chloroxylenol in a glycerine gel base. The alcohol acts as a very effective disinfectant, while the glycerine base prevents chafing and chapping of the hands from the alcohol. However, the relatively-large containers storing these alcohol-glycerine gels are usually stored at a central location that is distant from the patients' rooms in a hospital, and the like. Since it is not feasible to return to such a central location after having examined every patient, nor of carrying such large containers around, the doctor or nurse will just simply wash the hands with soap and water, or not wash them at all, if they have become chafed and chapped from repeated and frequent soap-and-water washings, thus exposing patients to possible infection during the examination by the physician or nurse.

SUMMARY OF THE INVENTION

It is the primary objective of the present invention to provide a small dispenser for an alcohol-glycerine disinfecting gel that may be worn on-the-person, such as being attached to the belt.

It is another objective of the invention to provide such a dispenser that is small enough so that its contents may be dispensed by using just one hand.

It is yet another objective of the invention to provide a small dispenser of an alcohol-glycerine disinfecting gel which utilizes replaceable supply-cartridges, with each supply-cartridge filled with an alcohol-glycerine disinfecting gel, which supply-cartridge is easily inserted into the dispenser when full, and easily removed therefrom when empty for replacement with a new, full cartridge.

Toward these and other ends, the dispenser of the invention for dispensing an alcohol-glycerine disinfecting gel for use by doctors and nurses consists of a main housing which mounts a pumping mechanism for pumping out an alcohol-glycerine disinfecting gel from a replaceable, disposable supply-cartridge releasably mounted in the main housing. The main housing consists of two, relatively-movable upper and lower sections. The two sections may be moved relative to each other by the gripping of just one hand. Since the main housing is small enough to fit within a person's hand, the doctor or nurse may dispense the contents of an alcohol-glycerine disinfecting gel simply by squeezing the two parts together. This squeezing operates the pumping mechanism in the housing, to cause some of the alcohol-glycerine disinfecting gel to exit through an outlet formed in the main housing, while also loading alcohol-glycerine disinfecting gel into the pumping mechanism for the next dispensing thereof. The dispensing of the gel is applied directly onto the fingers of the same hand that has squeezed the main housing to have caused such dispensing to occur. Owing to the small size of the main housing, the dispenser of the invention may be worn on-the-person, person, such as the pants-belt. Toward this end, the main housing is provided with a loop or strap through which the belt may pass. Thus, a doctor or nurse may dispense an alcohol-glycerine disinfecting gel directly onto one hand at any time and at any location, in order to help prevent the spread of infection.

BRIEF DESCRIPTION OF THE DRAWING

The invention will be more readily understood with reference to the accompanying drawing, wherein.

DETAILED DESCRIPTION OF THE INVENTION

Figure 6:
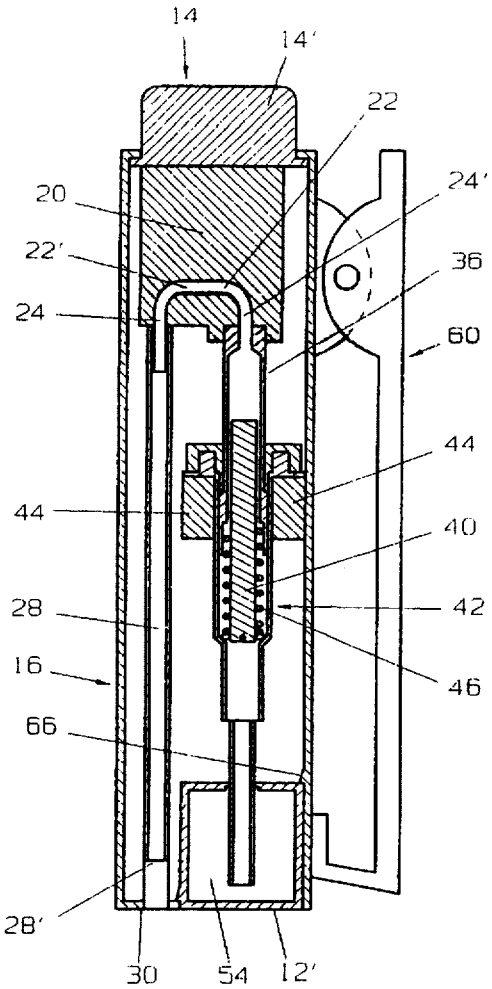
FIG. 6 is a cross-sectional view taken along line 6—6 of FIG. 3, which shows the state of the miniature dispenser for dispensing an alcohol-glycerine disinfecting gel of the invention is in its unsqueezed state.
Figure 7:
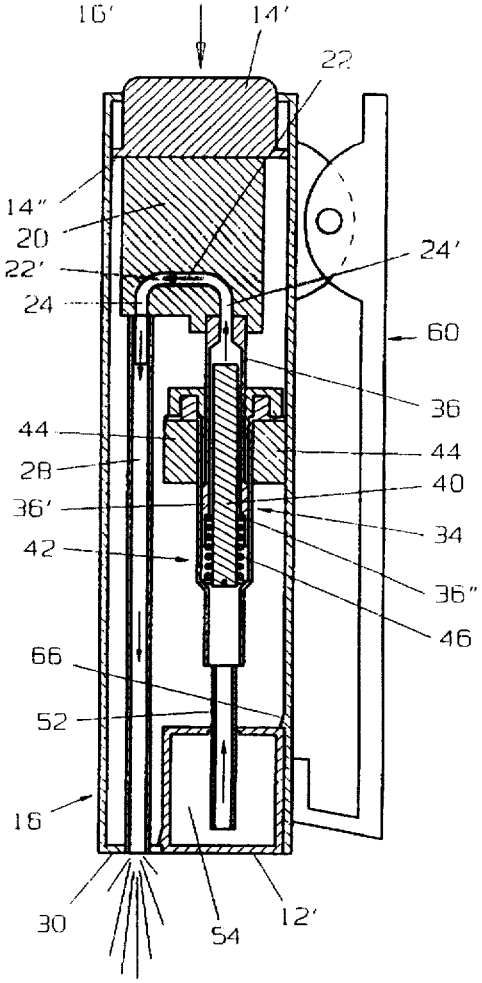
FIG. 7 is a cross-sectional view similar to FIG. 6 but showing the state of the miniature dispenser for dispensing an alcohol-glycerine disinfecting gel of the invention in its squeezed, dispensing state.

Referring now to the drawings in greater detail, where like reference numerals indicate like parts, the miniature dispenser for dispensing an alcohol-glycerine disinfecting gel is indicated generally by reference numeral 10. The miniature dispenser for dispensing an alcohol-glycerine disinfecting gel includes a main housing 12 made of a thermoplastic resin material consisting of two relatively-slidable sections: An upper section 14, and a lower section 16. The upper section 14 is slidable within the lower section 16, and has a main, upper protruding portion 14' against which a hand may push in order to slide the upper section downwardly into the lower section for actuating the pumping mechanism of the invention, as more fully described hereinbelow. The upper protruding portion 14' has a lower bead or flange 14" which prevents the upper protruding portion 14' from escaping the lower section 16, which flange 14" abuts against annular surface 16' of the upper surface of the lower section 16 when the upper protruding portion 14' is in its uppermost position, when the spring of the pumping mechanism returns the upper protruding portion to its free state, as described hereinbelow. Fixedly secured to the upper protruding portion 14' is a downwardly-extending mounting block 20 which mounts therein a portion of the dispensing mechanism. Within the mounting block 20 (see FIG. 7), there is provided a U-shaped internal passageway 22 which has a horizontal leg 22' and two vertical legs 24, 24' which are in fluid communication with the ends of the horizontal leg 22'. The internal vertical leg 24 is coupled to an external dispensing tube 28, which tube 28 extends the majority of the height of the main housing 12. The dispensing tube 28 defines a lower end 28' (see FIG. 6) which slides in upstanding, vertical tubular member 29, which terminates in opening or orifice 30 formed in the bottom wall 12' of the main housing's lower section, through which opening 30 the small quantity of alcohol-glycerine disinfecting gel exits onto to the fingers of the very same hand that squeezed the dispenser, in the manner seen in FIG. 5. The other internal horizontal leg 24' exits from the mounting block 20 and turns into an internal passageway of a cylinder 36 of a pumping mechanism 34.

The lower section 16 of the main housing mounts the second half of the pumping mechanism 34, which includes pumping piston 40 which slides within the pumping cylinder 36. The pumping piston 40 is mounted in a mounting frame 42 fixedly secured to the internal surface of the lower section 16 via ears 44. Mounting frame 42 defines a lower, converging section 42' in which is seated the lower end of a compression spring 46. The lower end of the pumping piston 40 is also fixedly secured to the mounting frame 42 at this converging section 42' by a locking pin 40', or the like. The lower end of pumping cylinder 36 has an enlarged portion 36' which defines an interior step 36" against which the upper end of the spring 46 abuts for causing the upper section of the main frame to move away from the lower section in the free state, when no force is applied by a hand to dispense the gel. The mounting frame 42 terminates in a lower tubular section 50, the lower end of which is connected to a supply tube 52. The supply tube 52 extends downwardly into a supply cartridge or container 54 in which is stored the alcohol-glycerine disinfecting gel being dispensed. The alcohol-glycerine disinfecting gel is forced up through the supply tube 52, then through the tubular section 52, through the interior of the mounting plate 42 by flowing around and through the spring 46, and then to the interior of the pumping cylinder 36 by passing in between the outer circumference of the pumping piston 40 and the interior surface of the pumping cylinder. Thereafter, the alcohol-glycerine disinfecting gel is forced out through the internal U-shaped passageway 22, and then is dispensed through opening 30 after having passed through tube 28. Each droplet of alcohol-glycerine disinfecting gel travels this same path; however, it takes two pumping actions of the pumping mechanism to accomplish this. That is, when the upper and lower sections 14, 16 are squeezed together, the alcohol-glycerine disinfecting gel contained in the interior of the cylinder 36 is forced out. When the upper and lower sections are allowed to return to their normal state by means of the spring, such action will draw or suck up new alcohol-glycerine disinfecting gel into the interior of the cylinder which will be dispensed the next time the upper and lower sections are squeezed together. This pumping method for accomplishing the dispensing by first priming or loading the cylinder every time there is a dispensing, is well-known and conventional.

Figure 1:
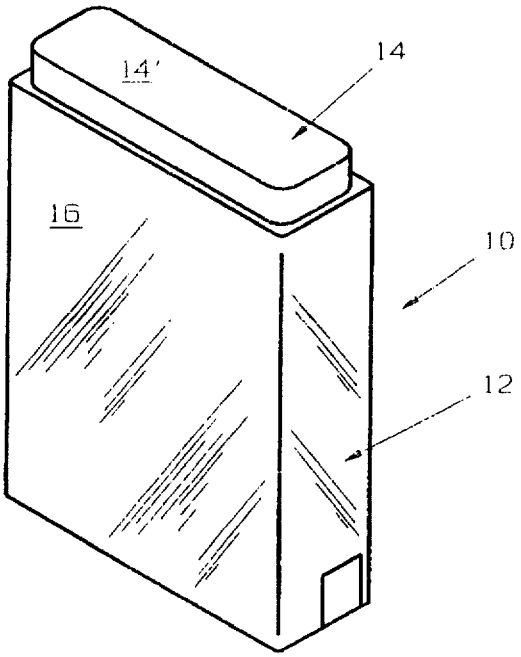
FIG. 1 is an isometric view of the miniature dispenser for dispensing an alcohol-glycerine disinfecting gel.
Figure 3:
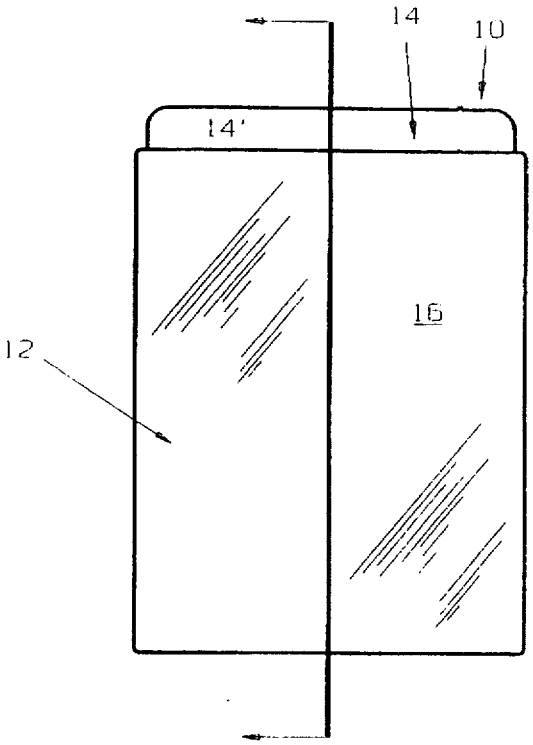
FIG. 3 is a front view thereof.
Figure 2:
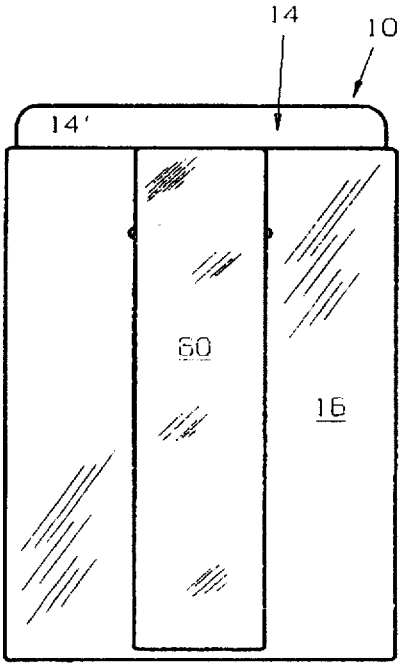
FIG. 2 is a rear view thereof.
Figure 4:
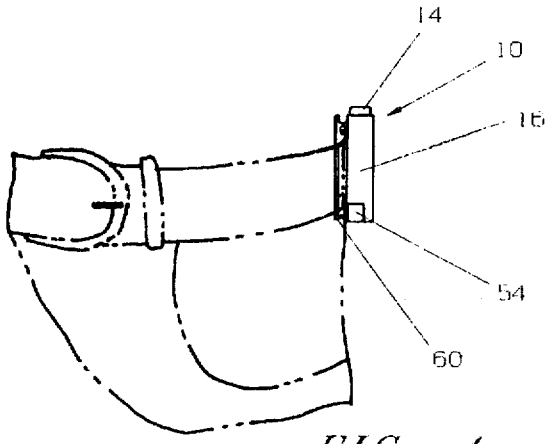
FIG. 4 is a plan view showing the miniature dispenser for dispensing an alcohol-glycerine disinfecting gel of FIG. 1 worn on-the-person by means of the waist-belt.
Figure 5:
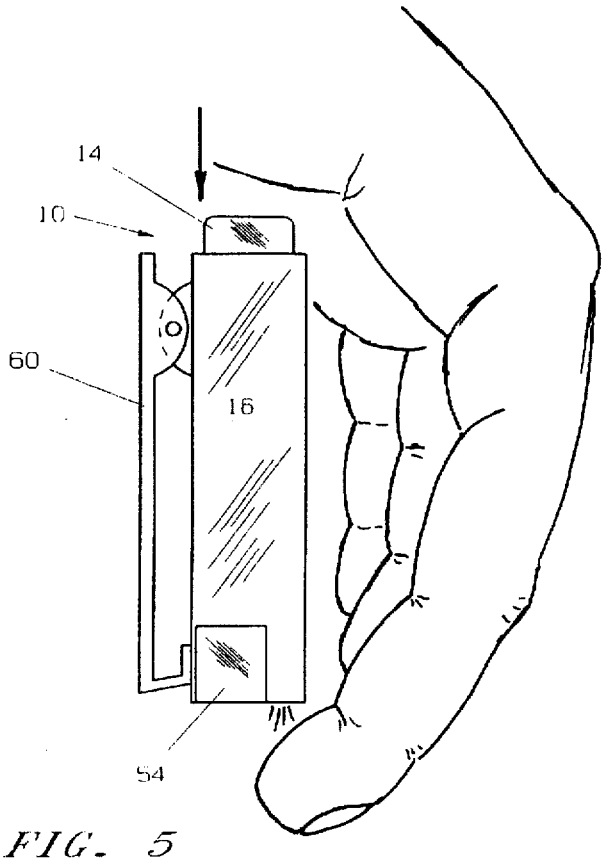
FIG. 5 is a side view showing how the miniature dispenser for dispensing an alcohol-glycerine disinfecting gel of FIG. 1 may be squeezed for dispensing by using just one hand, with the dispensed contents exiting onto the fingers of the hand that squeezed the dispenser for causing the dispensing.

As can be seen in FIG. 5, the dispenser 10 is of small enough size so as to fit inside a hand, so that just one hand may perform the squeezing together of the upper and lower sections 14, 16. The main housing 12 is also provided with a mounting loop 60 that is used for passing a waist-belt therethrough, so that the dispenser may be carried on-the-person, as seen in FIG. 4. The mounting loop or strap is connected to the rear face of the lower section 16 of the main housing.

Figure 8:
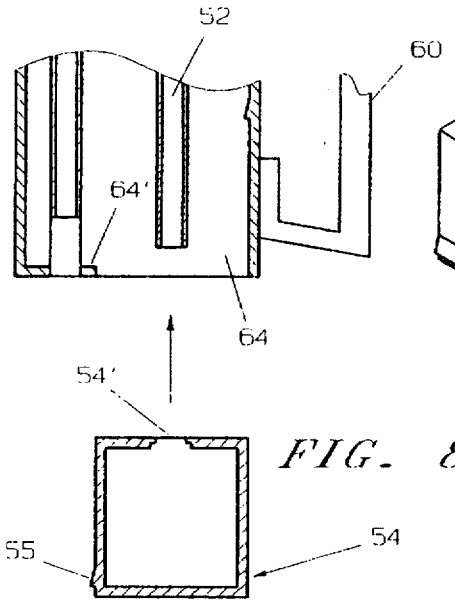
FIG. 8 is a plan view showing the replaceable, disposable supply-cartridge of alcohol-glycerine disinfecting gel, and how it is mounted in the main housing of the miniature dispenser.
Figure 9:
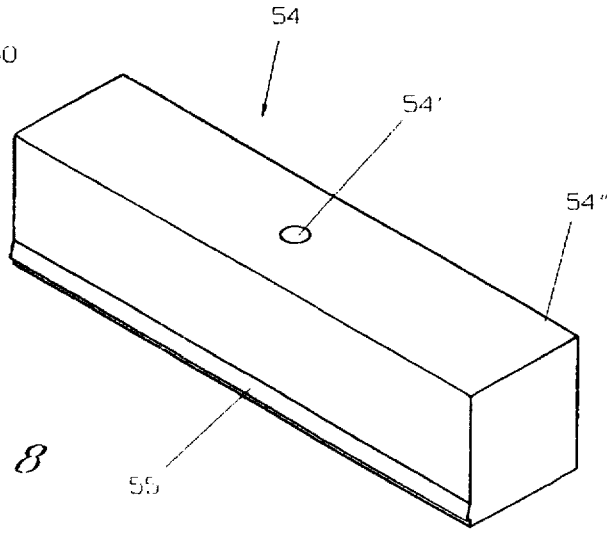
FIG. 9 is an isometric view of the replaceable, disposable supply-cartridge of alcohol-glycerine disinfecting gel.

The supply cartridge 54 is disposable and replaceable, so that when the supply of the cartridge runs out, it may be removed and replaced with a new, full cartridge. As seen in FIG. 9, the supply cartridge 54 has a through-hole 54' through which passes the lower end of the tube 52, as described above, and an elongated bead 55. The bottom of the lower section 16 of the main housing has a cut-way, or open, bottom-corner section 64 (see FIG. 8), which allows for the insertion of the supply cartridge into the interior of the main housing. The interior rear surface of the main housing has a bead 66 (see FIG. 6) against which the upper corner 54" of the supply cartridge abuts during loading of the supply cartridge. The bead 66 extends preferably the entire length of the rear wall of the main housing, in the manner that the bead 55 of the supply cartridge extends the full length of the supply cartridge, since, preferably, the lengths of the housing and the supply cartridge are the same. The diagonally-opposite lower corner of the supply cartridge is provided with a beaded portion 55 which cooperates with the free, exposed edge 64' of the open bottom section of the main housing. The beaded section 55 defines a downwardly canted surface, whereby when the supply cartridge is pushed up into the main housing during insertion, the beaded portion 55 is cammed inwardly to allow clearance past the edge 64', whereupon after clearance, the beaded portion resumes its original shape, in order to provide a snap-fit connection, in the well-known manner. During insertion of the new cartridge 54, the bottom end of the tube 52 is pushed through the opening 54' in the top surface of the supply, whereby the alcohol-glycerine disinfecting gel is ready to be dispensed. When removing the empty cartridge, owing to the resilient and flexible thermoplastic resin material from which the dispenser 10 is made, one merely pulls the front surface of the lower section 16 of the main housing away from the rear surface thereof, as by via the dispensing opening 30, whereby the bead 55 is allowed to clear past the edge 64'.

It is noted that while it has been shown that the discharge opening 30 is at the bottom of the main housing 12, it is within the scope and purview of the invention to dispense from the top of the housing or from the side thereof. Also, besides a gel being dispensed, a liquid may also be dispensed.

While a specific embodiment of the invention has been shown and described, it is to be understood that numerous changes and modifications may be made therein without departing from the scope, spirit and intent of the invention as set forth in the appended claims.

What I claim is:

1. In a dispenser for dispensing small amounts of a solution comprising a main housing and a discharge outlet operatively associated with said main housing, supply means mounted by said main housing for providing a supply of a solution to be dispensed, pumping means for pumping out the solution from said supply means through said discharge outlet, wherein the improvement comprises:

said main housing being of a small overall size so as to be operable by one hand for pumping out said solution;

and securing means operatively associated with said main housing for securing said main housing to a person in a substantially vertically-oriented position, whereby the dispenser may be worn on-the-person for transport with the person;

said supply means comprising a supply of disinfecting liquid or gel for disinfecting the hands;

said discharge outlet having a discharge opening facing outwardly when said securing means mounts said main housing to a person for dispensing the disinfecting liquid or gel;

said discharge outlet dispensing said disinfecting liquid or gel for disinfecting the hands directly onto said one hand that operates said pumping means for pumping out said solution while said main housing is secured to the securing means.

2. The dispenser for dispensing small amounts of a solution according to claim 1, wherein said disinfecting liquid or gel for disinfecting the hands comprises an alcohol-glycerine disinfecting solution.

3. The dispenser for dispensing small amounts of a solution according to claim 1, wherein said supply means comprises a removable supply cartridge; said main housing comprising first cooperating means for removably mounting said supply cartridge therein; said supply cartridge comprising second cooperating operatively associated with said first cooperating means for allowing replacement of an empty said supply cartridge with a new full said supply cartridge.

4. The dispenser for dispensing small amounts of a solution according to claim 1, wherein said main housing comprises a first section and a second section, said first and second sections being being slidably mounted together for relative movement to each other, and being slid toward each other by the squeezing of one hand; said first and second sections mounting said pumping means; said sliding movement of said first and second sections operating said pumping means for pump said liquid or gel from said supply means through said pumping means, and out through said discharge opening.

5. The dispenser for dispensing small amounts of a solution according to claim 1, wherein said securing means comprising a strap for passing a waist-belt therethrough, whereby the main housing may be worn by a person via the waist-belt.

6. The dispenser for dispensing small amounts of a solution according to claim 4, wherein said first section is the upper section of said main housing, and said second section is the lower section of said main housing; said pumping means comprising first passageway means mounted by said first section; said first passageway means being movable toward and away from said discharge outlet; said discharge outlet being formed in said second section; said pumping means having second passageway means mounted to said second section, said second passageway means comprising one of a piston and cylinder, and said first passageway means comprising the other of said piston and cylinder, said piston and cylinder being operably to pump out small quantities of said liquid or gel.

7. The dispenser for dispensing small amounts of a solution according to claim 6, wherein said second section comprises a tubular member associated with said discharge opening, said first passageway means having a portion thereof that slides in said tubular member, whereby the exit of said first passageway means is always aligned with said discharge opening.

8. A method of dispensing a small amount of alcohol-disinfecting solution by means of a small dispenser having a discharge outlet and a supply of said solution, comprising:

(a) attaching the small dispenser in a substantially vertically-oriented position to a person;

(b) dispensing a small quantity of said solution into a hand of the person to whom said dispenser has been attached while said small dispenser is still attached to the person;

(c) said step (b) comprising inserting the entire dispenser into one hand of the person to whom said dispenser is attached while said dispenser is attached to said person, and squeezing said dispenser with said one hand to cause a small amount of said solution to exit through the discharge opening of said discharge outlet onto said one hand, said solution exiting through said discharge opening during said step of dispensing.

9. The method of dispensing a small amount of alcohol-disinfecting solution according to claim 8, further comprising:

(d) prior to said step (b), removably inserting a full, disposable supply-cartridge filled with said solution.

10. The method of dispensing a small amount of alcohol-disinfecting solution according to claim 9, further comprising:

(e) after said step (d), removing the supply-cartridge of said step (d) when it has become empty; and (f) removably inserting another, full, disposable supply-cartridge filled with said solution in place of said empty one.

11. The method of dispensing a small amount of alcohol-disinfecting solution according to claim 8, wherein said step (b) comprises dispensing the solution from the bottom of the dispenser; and said step (c) comprises dispensing the solution directly only at least one finger of said one hand that squeezes the dispenser.

12. The method of dispensing a small amount of alcohol-disinfecting solution according to claim 8, wherein said step (c) comprises dispensing the solution directly onto at least one finger of said one hand that squeezes the dispenser.

13. The method of dispensing a small amount of alcohol-disinfecting solution according to claim 10, further comprising, before said steps (e) and (f), removing the dispenser from its attachment to the person.

14. The method of dispensing a small amount of alcohol-disinfecting solution according to claim 8, wherein said step (a) comprises securing the dispenser to the waist-belt of the person.

15. In a dispenser for dispensing small amounts of a solution comprising a main housing and a discharge outlet operatively associated with said main housing, a supply of solution to be dispensed by said main housing, pumping means for pumping out the solution from said main housing through said discharge outlet, wherein the improvement comprises:

said main housing being of a small overall size so as to be operable by one hand for pumping out said solution;

and securing means operatively associated with said main housing for securing said main housing to a person in a substantially vertically-oriented position whereby the dispenser may be worn on-the-person for transport with the person;

said supply of solution comprising a disinfecting liquid or gel for disinfecting the hands;

said discharge outlet having a discharge opening facing outwardly when said securing means mounts said main housing to a person for dispensing the disinfecting liquid or gel;

said discharge outlet dispensing said disinfecting liquid or gel for disinfecting the hands directly onto said one hand that operates said pumping means for pumping out said solution while said main housing is secured to the securing means.

* * * * *